US005655313A

United States Patent [19]

Hope et al.

[11] Patent Number: 5,655,313

[45] Date of Patent: Aug. 12, 1997

[54] APPARATUS FOR FLUIDIZED, VACUUM DRYING AND GAS TREATMENT FOR POWDERED, GRANULAR, OR FLAKED MATERIAL

[76] Inventors: Stephen F. Hope; Joseph B. Kejha, both of 3701 Welsh Rd., Willow Grove, Pa. 19090-1293

[21] Appl. No.: 251,089

[22] Filed: May 31, 1994

[51] Int. Cl.[6] ..... F26B 5/08

[52] U.S. Cl. ..... 34/323; 34/325; 34/108; 34/109

[58] Field of Search ..... 34/605, 607, 409, 34/410, 411, 139, 140, 108, 109, 92, 323

[56] References Cited

U.S. PATENT DOCUMENTS

| | | | |
|---|---|---|---|
| 2,816,081 | 12/1957 | Heath et al. | 34/108 |
| 3,231,909 | 2/1966 | Candor | 34/605 |
| 3,811,822 | 5/1974 | Cherenson | 34/108 |
| 4,010,550 | 3/1977 | Freze | 34/135 |
| 4,305,211 | 12/1981 | Peterson | 34/605 |
| 4,860,462 | 8/1989 | Gobel | 34/108 |
| 5,267,455 | 12/1993 | Dewees et al. | 34/72 |
| 5,302,201 | 4/1994 | Lucke | 34/607 |

FOREIGN PATENT DOCUMENTS

| | | | |
|---|---|---|---|
| 6-117755 | 4/1994 | Japan | 34/92 |

*Primary Examiner*—Edward K. Look
*Assistant Examiner*—Mark Sgantzos
*Attorney, Agent, or Firm*—Zachary T. Wobensmith, III

[57] ABSTRACT

Apparatus for drying and/or treating powdered, granular, or flaked material in combination with a containment room or glove box under controlled atmospheric conditions, which may have an oven in the room with a chamber with a vessel therein to carry material, the chamber having a door to seal it off and vacuum creation and gas supplying features directly therefor, the vessel which carries material for drying and/or treating is supported on a frame with provisions for rotation by motor equipment, with heater elements around the outside of the chamber to provide heat if required, and vanes inside the vessel to fluidize the material upon rotation and the application to the vessel of vacuum, heat, and/or gas for drying and/or treating the material as required.

7 Claims, 3 Drawing Sheets

APPARATUS FOR FLUIDIZED, VACUUM DRYING AND GAS TREATMENT FOR POWDERED, GRANULAR, OR FLAKED MATERIAL

BACKGROUND OF THE INVENTION

1. Field of the Invention

This invention relates to apparatus of the heated vacuum rotary vessel type for drying and/or treating powdered, granular or flaked material.

2. Description of the Prior Art

Drying of powdered material under conditions of vacuum or heat is a concept that has long been known in the prior art. Such apparatus usually included a furnace with the powdered material on a static plate and with vacuum applied to the chamber surrounding the plate. This apparatus does not fluidize the material.

Another prior art apparatus included a fine screen supporting a bed of material through which dry air was blown, which fluidized the bed and which air exited through a cloth bag. This apparatus loses or classifies a portion of the material through the bag, cannot get the material drier than the surrounding atmosphere, and does not dry uniformly due to the tendency of the heavier particles to be at the bottom of the mix.

None of the prior art apparatus completely and properly dried the material.

Rotary furnaces which expose the material therein to heat are known, and particularly in the portland cement industry, but are not satisfactory for drying and treatment of many materials and do not operate under controlled atmospheric or vacuum conditions.

The uniform and homogenous drying of powdered, granular or flaked materials under conditions of heat and vacuum as they free fall in a rotating vessel offers advantages not found in the prior art.

The uniform and homogenous processing of material by passing gas over and through powdered, granular, or flaked materials as they free fall in controlled atmospheric conditions and in a gas atmosphere while in a heated or unheated rotating vessel, offers advantages not found in the prior art.

Certain materials such as powdered materials for anhydrous alkali metal batteries, organic and inorganic chemicals, pharmaceutical, biological, metallurgical and nuclear products require uniform and homogenous processing or drying in an environment where there are no contaminants, such as moisture, where drying is controlled and for certain materials processing can advantageously occur while in the apparatus.

SUMMARY OF THE INVENTION

It has now been found that the drying efficiency and homogenity of powdered, granular, or flaked materials can be greatly increased by the fluidizing of the material by repeated gravity induced free fall in a rotating vessel while it is under controlled heat, atmospheric and/or vacuum conditions. The material can also be treated while in the vessel by the injection of a suitable gas for processing or treatment.

This invention relates to apparatus for vacuum drying and/or treatment of powdered, granular, or flaked material, or mixtures thereof, where the material is contained in a vessel which is in a chamber, which has controlled conditions of heat, atmosphere or vacuum, with the vessel rotating about an axis that is other than vertical, and with a plurality of vane members arranged around its inside periphery and open toward the center of the vessel, which contain the material until it is at or near the top of the vessel's rotation.

The principal object of the invention is to provide a rotating vessel in a chamber for fluidized drying of powdered, granular or flaked material under controlled conditions.

A further object of the invention is to provide apparatus of the character aforesaid which is highly efficient, reliable, and economical to operate.

A further object of the invention is to provide apparatus of the character aforesaid which is useful with a wide variety of materials.

A further object of the invention is to provide apparatus of the character aforesaid which does not classify nor require classification of the materials by size or weight, and does not lose any material during drying or processing.

A further object of the invention is to provide apparatus of the character aforesaid which is useful for both drying and/or treatment of materials by gas injection into the materials under controlled conditions.

Other objects and advantageous features of the invention will be apparent from the accompanying description and claims.

DESCRIPTION OF THE DRAWINGS

The nature and characteristic features of the invention will be more readily understood from the following description taken in connection with the accompanying drawings forming part hereof in which.

It should of course be understood that the description and drawings herein are merely illustrative, and that various modifications and changes can be made in the structures disclosed without departing from the spirit of the invention.

Like numerals refer to like parts throughout the several views.

DESCRIPTION OF THE PREFERRED EMBODIMENTS

Figure 1:
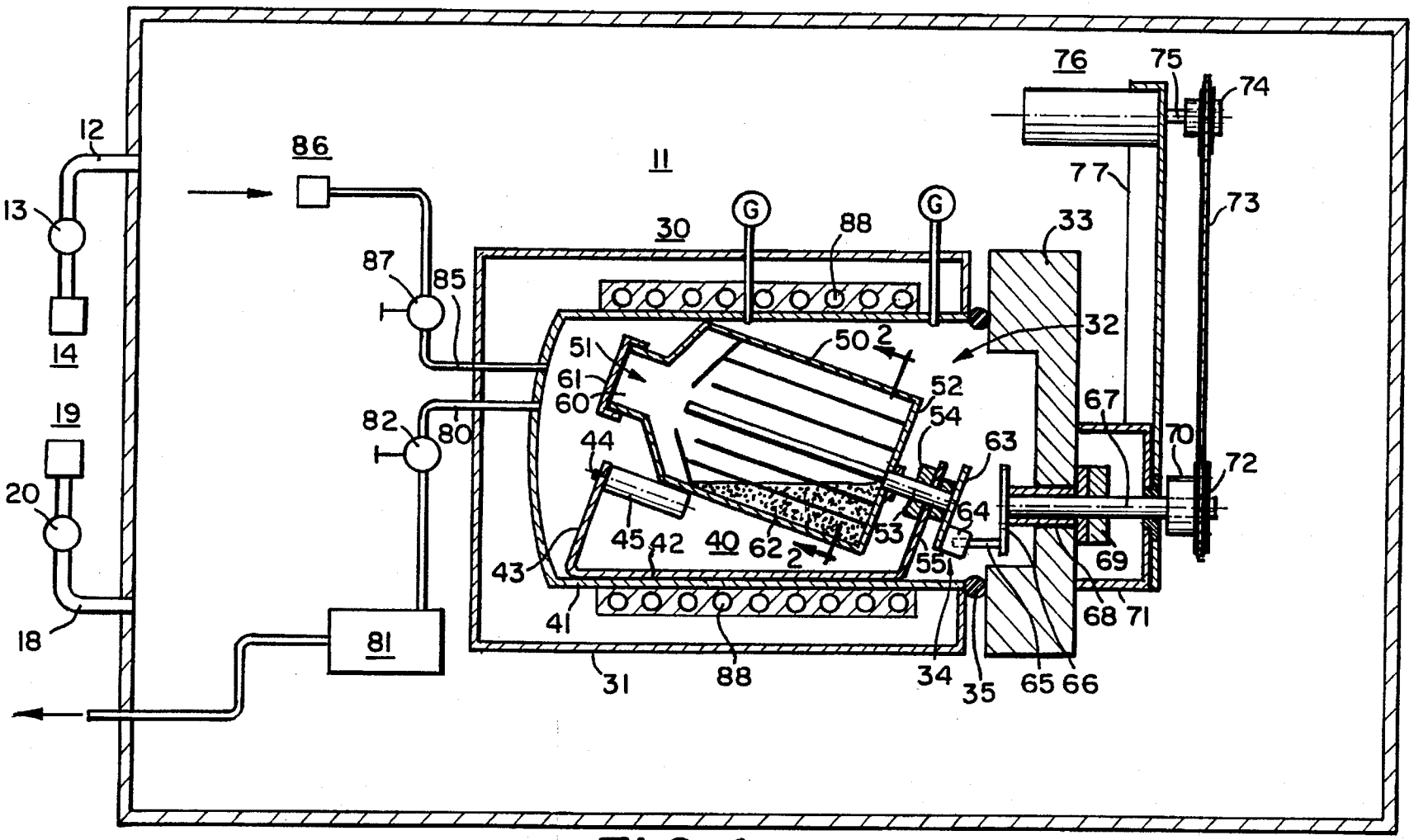
FIG. 1 is a diagrammatic view of one embodiment of the apparatus of the invention for drying material.
Figure 2:
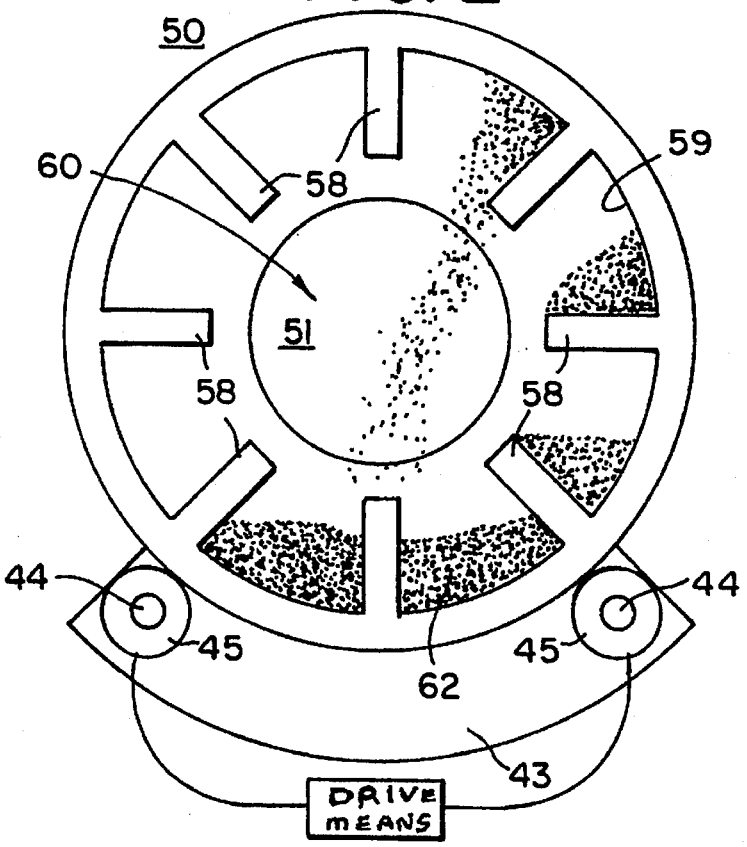
FIG. 2 is a vertical sectional view, enlarged, taken approximately on the line 2—2 of FIG. 1.

Referring now more particularly to the drawings and FIGS. 1 and 2 thereof one embodiment of apparatus which is useful for drying powdered, granular, or flaked materials is therein illustrated. A containment room or glove box 10 is provided within which the apparatus 11 is located. The room 10 is of air tight construction and has a pipeline 12 connected thereto and to a vacuum creating source 14, such as a vacuum pump. An on-off valve 15 is provided in pipeline 12 between the room 10 and vacuum source 14. A pipeline 18 is also connected to room 10 and to a source of dry gas 19, preferably of an inert well known type, such as argon gas. An on-off valve 20 is in pipeline 18 between the room 10 and the inert gas source 19. The room 10 is provided with suitable means of ingress and egress (not shown) such as hinged sealed doors (not shown) as required. Within the room 10 an oven 30 is provided which includes an outer housing 31 preferably of steel or the like which is hollow and open at one end 32. A door 33 is provided which is preferably hinged (not shown) to housing 31 for closing off open end 32 to provide a vacuum chamber 34, but could be at the other end and replaced by a wall (not shown). A sealing strip 35 is provided which extends around the outside of the open end 32 of housing 31, and seals off the housing 31 when door 33 is closed. The sealing strip 35 is of any suitable well-known conventional type, which is also heat resistant.

Within the oven 30 a removable frame 40 is provided which can rest on the floor 41 of the oven. The frame 40 includes a horizontal member 42 which rests on the floor 41, with a front member 43, which has two shafts 44 therein which mount rollers 45.

A vessel 50 is provided, preferably of cylindrical shape, open at one end 51, which is carried on the rollers 45, and at the end 52 opposite to end 51 has a shaft 53 extending therefrom.

The vessel 50 is tilted along its central axis with respect to the floor 41, with the open end 51 higher than end 52.

The shaft 53 is carried in a bearing 54 of well known type, which is heat resistant and mounted to a rear frame member 55, which extends upwardly from member 42.

The rollers 45 which can optionally be driven (not shown) are of well known type, and are also heat resistant.

The vessel 50 is preferably constructed of heat resistant steel with a plurality of spaced raised vanes 58 around its interior surface 59.

The vanes 58 extend substantially the length of vessel 50, terminate prior to the open end 51 and face towards the center of the vessel 50.

While raised vanes are shown, ridges or fingers (not shown) could be substituted if desired.

The end 51 of vessel 50 has a circular opening 60, which can be fitted with a removable screen 61, which is of selected mesh size such that material 62 in vessel 50 will not readily pass therethrough.

The shaft 53 has a carrier 63 thereon with a plate 64 extending therefrom, which can be selectively engaged by a pin 65 carried on a disk 66, which is mounted on a shaft 67 which is journaled in a bearing 68 in door 33. A seal 69 of conventional well known type is engaged with shaft 67 outside of door 33 to maintain the vacuum integrity of the oven 30.

The shaft 67 is also journaled in bearing 70 carried in bracket 71 fastened to door 33 and has a sprocket 72 thereon. A chain 73 is engaged with the sprocket 72, and with a sprocket 74 on output shaft 75 which extends from an electric motor 76, which is shown mounted on a bracket 77 also carried on door 33, but could alternately be mounted on a wall (not shown) if desired.

If desired, the forgoing sprockets, shafts and chain could be eliminated and replaced by a magnetic coupling of well known type (not shown) attached to the motor 76.

The motor 76 can be of the type which provides a full 360 degree rotation of the vessel 50, or if desired can reverse and provide less than a 360 degree rotation to rock the vessel 50, and fluidize the material 62.

The oven 30 has a pipeline 80 connected to chamber 34 and to a vacuum pump 81, with a shut off valve 82 connected to pipeline 80 between chamber 34 and pump 81. A second pipeline 85 is connected to chamber 34 and to a source of dry gas 86, which can be of any suitable type, such as argon, and with a shut-off valve 87 in pipeline 85.

The oven 30 is also provided with heating elements 88 of conventional type, and which are located around the outside of the chamber 34 to heat the material 62 if desired.

It should be noted that while specific structure has been described, the containment room, chamber, or vessel can be of any desired type or configuration capable of providing contained controlled atmosphere, heat, humidity or vacuum conditions. The vessel can also be of any type or configuration capable of rotating about an axis that is other than vertical while fluidizing the material therein for drying or other treatment.

Figure 4:
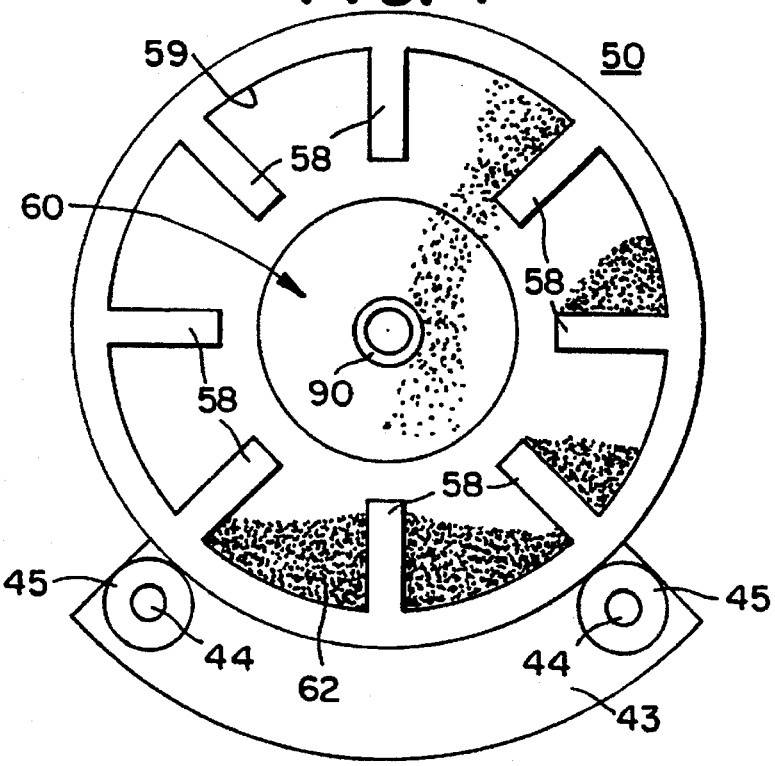
FIG. 4 is a vertical sectional view, enlarged, taken approximately on the line 4—4 of FIG. 3.
Figure 3:
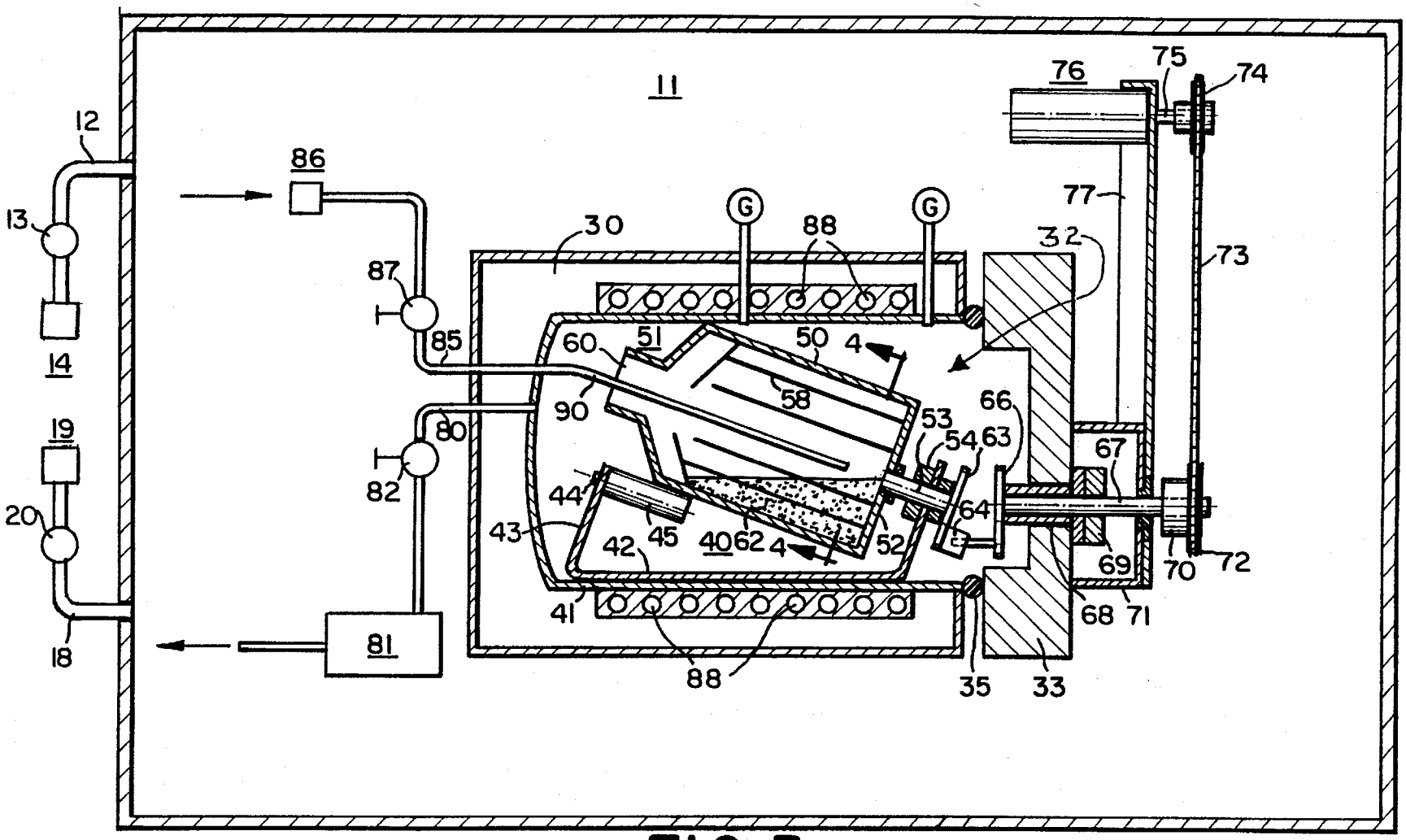
FIG. 3 is a view similar to FIG. 1 illustrating another embodiment of the apparatus set up for injecting gas into the apparatus for treating the material.

Referring now to FIGS. 3 and 4 another embodiment of apparatus is shown therein which is identical to that described for FIGS. 1 and 2 with the exception that the apparatus is set up for treating the powdered, granular or flaked material. Material 62 carried in vessel 50 can be transformed by heating it and passing a gas therethrough which reacts with the material and produces the desired product.

For this application the pipeline 85 is increased by a length 90 which extends into the interior of vessel 50, so that gas for treating the material 62 comes directly into contact with the material as vessel 50 rotates.

The mode of operation will now be pointed out.

Referring first to FIGS. 1 and 2 the vessel 50 on frame 40 is in room 10 and initially outside of oven 30, the screen 61 has been removed and the vessel 50 is filled with material 62 to be dried. Screen 61 is replaced. The room 10 vacuum source 14 is activated, and room 10 is filled with dry gas, preferably inert, from source 19. The frame 40 and vessel 50 are moved into oven 30, and door 33 is closed and secured. Vacuum pump 81 is activated to provide a vacuum in chamber 34, heating elements 88 are energized, motor 76 is energized rotating shaft 75, sprocket 74, chain 73 and sprocket 72. Shaft 67 rotates causing disk 66 and pin 65 to rotate and plate 69 and carrier 63 on shaft 53 to rotate thereby rotating vessel 50.

As vessel 50 rotates the material 62 is fluidized and due to gravity free falls in the vacuum, mixing and giving off moisture. When the material 62 has been dried sufficiently, valve 87 is opened flooding chamber 34 with dry gas, which is preferably inert. The vacuum valve 82 is closed, valve 19 is opened and material 62 is then removed from vessel 50 and used as required. If desired, the vessel 50 can be rocked or rotated less than full 360 degree rotations, so long as the material is fluidized.

If treatment of the material is required then the apparatus is set up as shown in FIGS. 3 and 4. Heat may be applied in chamber 34 if required, valve 82 is opened, and valve 87 is opened to allow gas for treatment to flow into vessel 50 as it is rotated. The gas comes into direct contact with the material, which is converted or treated to provide the desired product.

When treatment is completed, valve 82 is closed, positive pressure is built up, valve 87 is closed, and vessel 50 is removed as described above.

It will thus be seen that apparatus has been provided with which the objects of the invention are achieved.

We claim:

1. Apparatus for drying and treating powdered, granular or flaked material which comprises containment means, said containment means is a sealable containment room, control means in communication with said room to control the conditions therein, oven means in said room having an interior chamber, gas supply and vacuum means in communication with said interior chamber to control the conditions therein, an opening in at least one end of said oven means for access to said chamber, door means engaged with said opening for selectively closing off access to said chamber, hollow vessel means in said interior chamber rotatable about an axis other than vertical for carrying material, said vessel means having internal vane means, frame means to support said vessel means and permit its selective movement into and out of said chamber, seal means between said door means and said chamber for sealing off said chamber upon closing of said door means, said vessel means is open at at least one end, to receive and discharge said material, vessel shaft means extending from said vessel means at the end opposite to said open end and engaged in a bushing in said frame means, said vessel means is supported by said shaft means in said frame means at an angle thereto other than vertical, said frame means has support means thereon for vessel means support, motor means connected to said vessel shaft means for rotation thereof and said vane means in said vessel means fluidizes said material upon rotation of said vessel means.

2. Apparatus as defined in claim 1 in which vacuum creating means are provided communicating with said room for creation of a vacuum therein.

3. Apparatus as defined in claim 1 in which gas supply means are provided communicating with said room.

4. Apparatus as defined in claim 1 in which said motor means includes an electric motor, an output shaft connected to said motor, a first sprocket on said output shaft, a chain connected to said first sprocket, a second sprocket connected to said chain mounted to a shaft, said shaft is mounted in a bearing means, shaft sealing means mounted on said shaft, a disk carried on said second sprocket shaft, plate means mounted to said vessel shaft means, and a pin carried by said disk for engagement with said plate means for rotation of said vessel means.

5. Apparatus as defined in claim 1 in which said support means includes a pair of rollers engaging said vessel means adjacent its open end.

6. Apparatus as defined in claim 1 which screen means is provided to selectively close off the open end of said vessel means.

7. Apparatus as defined in claim 5 in which said rollers are driven.

* * * * *